United States Patent [19]

Yamazaki et al.

[11] 4,221,990

[45] Sep. 9, 1980

[54] PHOSPHOR SCREEN FOR POST-FOCUSING TYPE COLOR PICTURE TUBE

[75] Inventors: Eiichi Yamazaki, Ichihara; Hiromi Kanai, Mobara; Masao Taniguchi, Mobara; Shigemi Hirasawa, Mobara, all of Japan

[73] Assignee: Hitachi, Ltd., Japan

[21] Appl. No.: 441,793

[22] Filed: Feb. 12, 1974

[30] Foreign Application Priority Data

Feb. 14, 1973 [JP] Japan ..... 48-17461

[51] Int. Cl.[2] ..... H01J 29/18; H01J 29/28

[52] U.S. Cl. ..... 313/466

[58] Field of Search ..... 313/466

[56] References Cited

U.S. PATENT DOCUMENTS

| | | | |
|---|---|---|---|
| 2,878,411 | 3/1959 | Alvarez | 313/467 X |
| 3,475,639 | 10/1969 | Driffort et al. | 313/106 |
| 3,692,576 | 9/1972 | Takayanagi et al. | 117/33.5 C |
| 3,767,447 | 10/1972 | Mizuno et al. | 117/33.5 C |
| 3,892,995 | 7/1975 | Yamazaki | 313/472 X |

OTHER PUBLICATIONS

Terrill, "Absorption of Cathode Rays in Aluminum Foil," Physical Review, vol. 24, 1924, pp. 616–621, Scientific Library.

*Primary Examiner*—Robert Segal
*Attorney, Agent, or Firm*—Craig & Antonelli

[57] ABSTRACT

A phosphor screen for a post-focusing type color picture tube comprising a faceplate, a phosphor layer on the faceplate, a metal back layer on the phosphor layer and a secondary electron emission suppressing layer on the metal backed phosphor screen, in which the thickness of the metal back layer and the density of the secondary electron emission suppressing layer take particular values for effective suppression of emission of secondary electrons from the phosphor screen.

9 Claims, 3 Drawing Figures

PHOSPHOR SCREEN FOR POST-FOCUSING TYPE COLOR PICTURE TUBE

The present invention relates to a post-focusing type color picture tube.

In a post-focusing type color picture tube, a strong electric field is established to form an electron lens between the phosphor screen and the shadow mask to focus electron beams, having passed through the shadow mask, due to the lens action for proper and satisfactory impingement on the phosphor screen. Therefore, electrons reflected on the gun-side of the shadow mask and/or emitted secondary electrons adjacent to the holes of the shadow mask are accelerated by the strong electric field between the phosphor screen and the shadow mask, and then impinge on the phosphor screen resulting in deterioration of color purity. Further, the electron beam impinging on the phosphor screen causes the secondary electrons emitted from the phosphor screen to re-impinge thereon with the color purity deterioration.

The present invention is intended to remove the above-mentioned drawbacks and to provide a post-focusing type color picture tube with excellent color purity which is adapted to suppress secondary electrons emitted from the phosphor screen and to cut off secondary electrons impinging on the phosphor screen.

According to the present invention, there is provided a phosphor screen for a post-focusing type color picture tube having a focusing rate of $\frac{1}{3}$–4/5, comprising a faceplate, phosphor layer on the faceplate, a metal back layer on the phosphor layer and a secondary electron emission suppressing layer on the metal back layer for suppressing emission of secondary electrons from the phosphor screen, in which the thickness of the metal back layer is about 4500–7000 Å and the density of the secondary electron emission suppresing layer is about 0.03–0.15 mg/cm$^2$.

Figure 1:
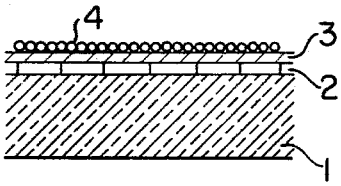
Figure 2A:
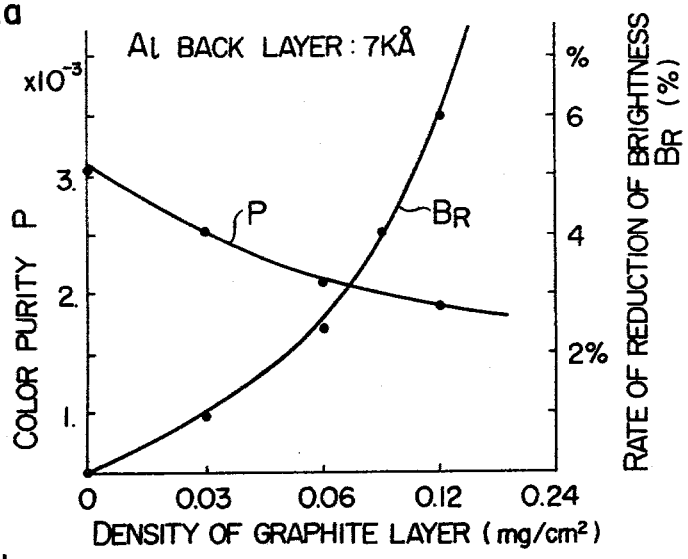
Figure 2B:
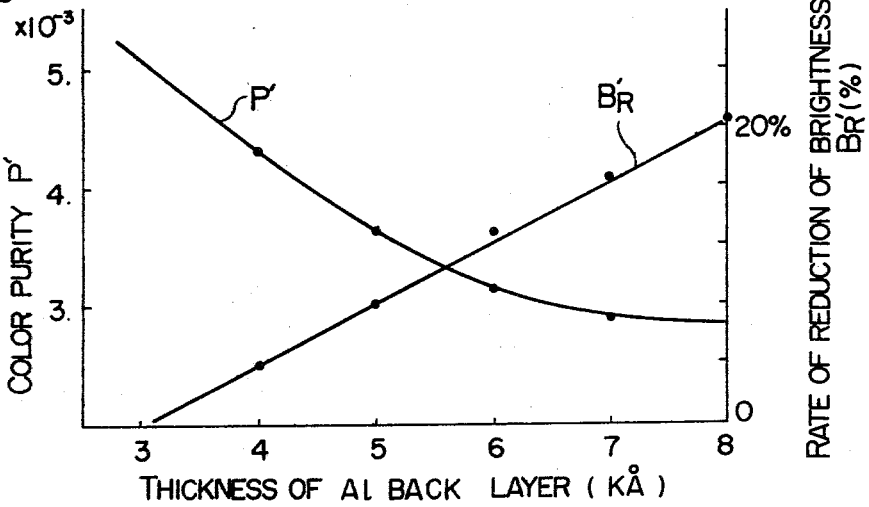

The invention will now be described by way of example only with reference to the accompanying drawings, in which:

FIG. 1 is a partial cross-section of a phosphor screen for a post-focusing type color picture tube according to the present invention;

FIG. 2*a* is a graph showing a relation of the density of a secondary electron emission suppressing layer to color purity and brightness; and FIG. 2*b* is a graph showing a relation of the thickness of a metal back layer to color purity and brightness.

The present invention will next be described in conjunction with FIGS. 1, 2*a* and 2*b*. Reference numeral 1 shows a faceplate of phosphor screen on which there is formed a phosphor layer 2, on which there is a further formed a metal back layer 3 made of, for example, aluminium. Reference numeral 4 shows a secondary electron emission suppressing layer for suppressing emission of secondary electrons from the phosphor screen, the layer being made of, for example, graphite or carbon black.

It should be borne in mind that a focusing rate, that is, the ratio of a voltage applied to a color selective electrode, for example, the shadow mask to that applied to the phosphor screen is almost in a range from $\frac{1}{3}$ to 4/5 in the color picture tube on which the phosphor screen according to the present invention is adapted to be mounted.

FIGS. 2*a* and 2*b* show results obtained from experiments carried out by the present inventors. When a voltage of 25 kV is applied to the phosphor screen and a voltage of 8 to 20 kV is applied to the shadow mask (not shown), an electric field is established by a potential difference between the phosphor screen and the shadow mask of 5 to 17 kV and causes the secondary electrons to be energized to impinge on the phosphor screen.

FIG. 2*a* shows a relating of the density of the secondary electron emission supressing layer 4 made of graphite to color purity P and the rate of reduction of brightness $B_R$. In the figure, the metal back layer 3 of aluminium is kept constant at 7 k Å in thickness. FIG. 2*b*, on the other hand, shows a relation of the thickness of the metal back layer 3 of aluminium to the color purity P′ and the rate of reduction of brightness $B_R'$. In the figure, the secondary electron emission suppressing layer 4 of graphite is kept constant at 0.06 mg/cm$^2$ in density. Further, the experiment showed that even if the metal back layer 3 in FIG. 2*a* was varied from about 4000 to 7000 Å in thickness, the mutual relation between the color purity P and the rate of reduction of brightness $B_R$ with respect to the density of the secondary electron emission suppressing layer 4 was kept substantially the same as that shown in the figure, and further that even if the secondary electron emission suppressing layer 4 in FIG. 2*b* was varied from about 0.03 to 0.15 mg/cm$^2$ in density, the mutual relation between the color purity P′ and the rate of reduction of brightnes $B_R'$ with respect to the thickness of the metal back layer 3 was kept substantially the same as that shown in the figure.

From FIG. 2*b* it has been found that these secondary electrons can be effectively cut off by the metal back layer made of, for example, aluminium about 4500 to 7000 Å thick. Further, the emission of the secondary electrons due to the impinging of the primary electrons on the phosphor screen is suppressed by the layer 4 of graphite or carbon black on the metal back layer 3. The secondary electron emission suppressing layer 4 of graphite or carbon black provides no sufficient suppression of the secondary electrons if far below 0.03 mg/cm$^2$ in density and provides a saturated suppression even if far above 0.15 mg/cm$^2$ in density. Further, the brightness may be deteriorated as the density of the secondary electron emission suppressing layer is increased far above 0.15 mg/cm$^2$ as shown in FIG. 2*a*. In these respects, the layer at a density about 0.03 to 0.15 mg/cm$^2$ is preferable and forms rather a thin layer with the brightness deteriorated as little as 2 to 7%.

As mentioned above, the present invention makes it possible to cut off the secondary electons impinging on the phosphor screen and to suppress the secondary electrons emitted from the phosphor screen with images produced which have an excellent color purity and less halation.

What we claim is:

1. A phosphor screen for a post-focusing type color picture tube having a focusing rate of $\frac{1}{3}$–4/5, comprising a faceplate, a phosphor layer on said faceplate, a metal back layer on said phosphor layer and a secondary electron emission suppressing layer on said metal back layer for suppressing emission of secondary electrons from said phosphor screen, in which the thickness of said metal back layer is about 4500–7000 Å and the density of said secondary electron emission suppressing layer is about 0.03–0.15 mg/cm$^2$.

2. A phosphor screen according to claim 1, in which said metal back layer consists of aluminium.

3. A phosphor screen according to claim 2, in which said secondary electron emission suppressing layer consists of graphite or carbon black.

4. A phosphor screen according to claim 1, in which said metal back layer comprises means for cutting off secondary electrons emitted from said phosphor screen for preventing the secondary electrons emitted from said phosphor screen from re-impinging on said phosphor screen.

5. A phosphor screen according to claim 4, in which said metal back layer consists of aluminum.

6. A phosphor screen according to claim 1, in which the post-focusing type color picture tube is provided with a color selective electrode, said color selective electrode emitting secondary electrons, and said metal back layer comprising means for cutting off secondary electrons emitted from said color selective electrode for preventing the secondary electons emitted from said color selective electrode from impinging on said phosphor screen.

7. A phosphor screen according to claim 6, in which said color selective electrode is a shadow mask.

8. A phosphor screen according to claim 7, in which said metal back layer consists of aluminum.

9. A phosphor screen according to claim 1, in which said post-focusing type color picture tube is provided with a shadow mask.

* * * * *